US006694520B2

(12) United States Patent
Smith

(10) Patent No.: US 6,694,520 B2
(45) Date of Patent: Feb. 24, 2004

(54) APRON AND PROTECTIVE DEVICE FOR CHILD CARE GIVER

(76) Inventor: Maureen Elizabeth Smith, 2903 Madaline Dr., Avenel, NJ (US) 07001-1352

( * ) Notice: Subject to any disclaimer, the term of this patent is extended or adjusted under 35 U.S.C. 154(b) by 302 days.

(21) Appl. No.: 09/940,721

(22) Filed: Aug. 29, 2001

(65) Prior Publication Data

US 2002/0029400 A1 Mar. 14, 2002

(51) Int. Cl.[7] ..... A41D 13/04
(52) U.S. Cl. ..... 2/48; 2/51
(58) Field of Search ..... 2/48, 49.1, 49.2, 2/49.3, 49.4, 49.5, 50, 51, 52, 102, 46, 104, 105, 106, 115, 80, 244, 246, 913; D2/861, 862, 863; 434/395, 98, 99, 211, 260, 176; 446/28, 227

(56) References Cited

U.S. PATENT DOCUMENTS 2,726,397 A * 12/1955 Stirton ..... 2/48
3,553,735 A * 1/1971 Jeffcoat ..... 2/52
3,624,686 A * 11/1971 Beals ..... 434/98
3,724,101 A * 4/1973 Slezak ..... 434/170
3,997,982 A * 12/1976 Holland ..... 434/260
4,037,272 A * 7/1977 Shani ..... 2/48
4,637,075 A * 1/1987 Ingrisano et al. ..... 2/94
4,661,072 A * 4/1987 White ..... 434/260
4,710,979 A * 12/1987 Bull et al. ..... 2/48
4,723,323 A * 2/1988 Wright, Jr. ..... 2/48
5,107,545 A * 4/1992 Potter ..... 2/46
5,468,152 A * 11/1995 Lenart ..... 434/429
5,718,589 A * 2/1998 McCracken et al. ..... 434/159
5,950,888 A * 9/1999 Nolan-Brown ..... 224/172
6,151,715 A * 11/2000 Doherty ..... 2/48
6,209,134 B1 * 4/2001 Schiesel ..... 2/102
6,224,450 B1 * 5/2001 Norton ..... 446/28

OTHER PUBLICATIONS

Simolicity Apron Pattern #9684.

* cited by examiner

*Primary Examiner*—Amy B. Vanatta
(74) *Attorney, Agent, or Firm*—Walter J. Tencza, Jr.

(57) ABSTRACT

An apparatus comprising an apron for a child care giver is provided. The apron may include a first attachment device having a plurality of shaped items attached to it and a second attachment device having a plurality of touchable items attached to it. The apron may be further comprised of a zipper device and a buttoning device connected so that they can be manipulated by a child. An upper pocket may be provided having a designation indicating that the upper pocket is to be used for storing medical supplies. A protective device may be connected to the apron for protection the wearer from untidy activities of children.

24 Claims, 8 Drawing Sheets

APRON AND PROTECTIVE DEVICE FOR CHILD CARE GIVER

FIELD OF THE INVENTION

This invention relates to improved methods and apparatus for aprons for caretakers of children particularly babies and children under the age of seven years old.

BACKGROUND OF THE INVENTION

Aprons are used in some child care centers as part of a uniform and/or a dress code. These aprons are typically of a general type and are used in non-child industries. Pockets are provided in these general type aprons which can be used as a holding space for first aid supplies, tissues, stationary, toys, and other items. However, since these general type aprons are not specifically directed towards child care, they are not adequate for child purposes.

SUMMARY OF THE INVENTION

The present invention in one embodiment discloses an apparatus comprising an apron for a child care giver. The apron may include a first attachment device having a plurality of shaped items attached to it and a second attachment device having a plurality of touchable items attached to it. Each touchable item may have a type of material, each type of material feeling different when touched.

Each of the plurality of shaped items may be easily detached from the first attachment device. The plurality of touchable items may be various types such as a soft touchable item, a rough touchable item, and a smooth touchable item.

The apron may be further comprised of a zipper device and a buttoning device each of which can be connected to the apron so that they can be manipulated by a child. The apron may be further comprised of an upper pocket having a designation indicating that the upper pocket is to be used for storing medical supplies such as Band-Aids and antiseptic wipes. The apron may also include a lower group of pockets for storing various items.

In one embodiment of the present invention a third attachment device may be connected to the apron and a protective device having a fourth attachment device may be connected to the apron by connecting the third and fourth attachment devices.

The present invention includes a method comprising the steps of attaching a first attachment device to an apron for a child care giver and attaching a plurality of shaped items to the first attachment device, wherein each of the plurality of shaped items may be detachable. The method may also include the steps of attaching a second attachment device to the apron, and attaching touchable items, each having a different feel, to the second attachment device. The method may also include attaching a zipper device, a buttoning device, and an upper pocket to the apron. The upper pocket may have designation indicating that the upper pocket is be used for storing medical supplies. The method may also include attaching a protective device to the apron such that it covers the first attachment device and the plurality of shaped items and the second attachment device and the plurality of touchable items.

DETAILED DESCRIPTION OF THE DRAWINGS

Figure 1:
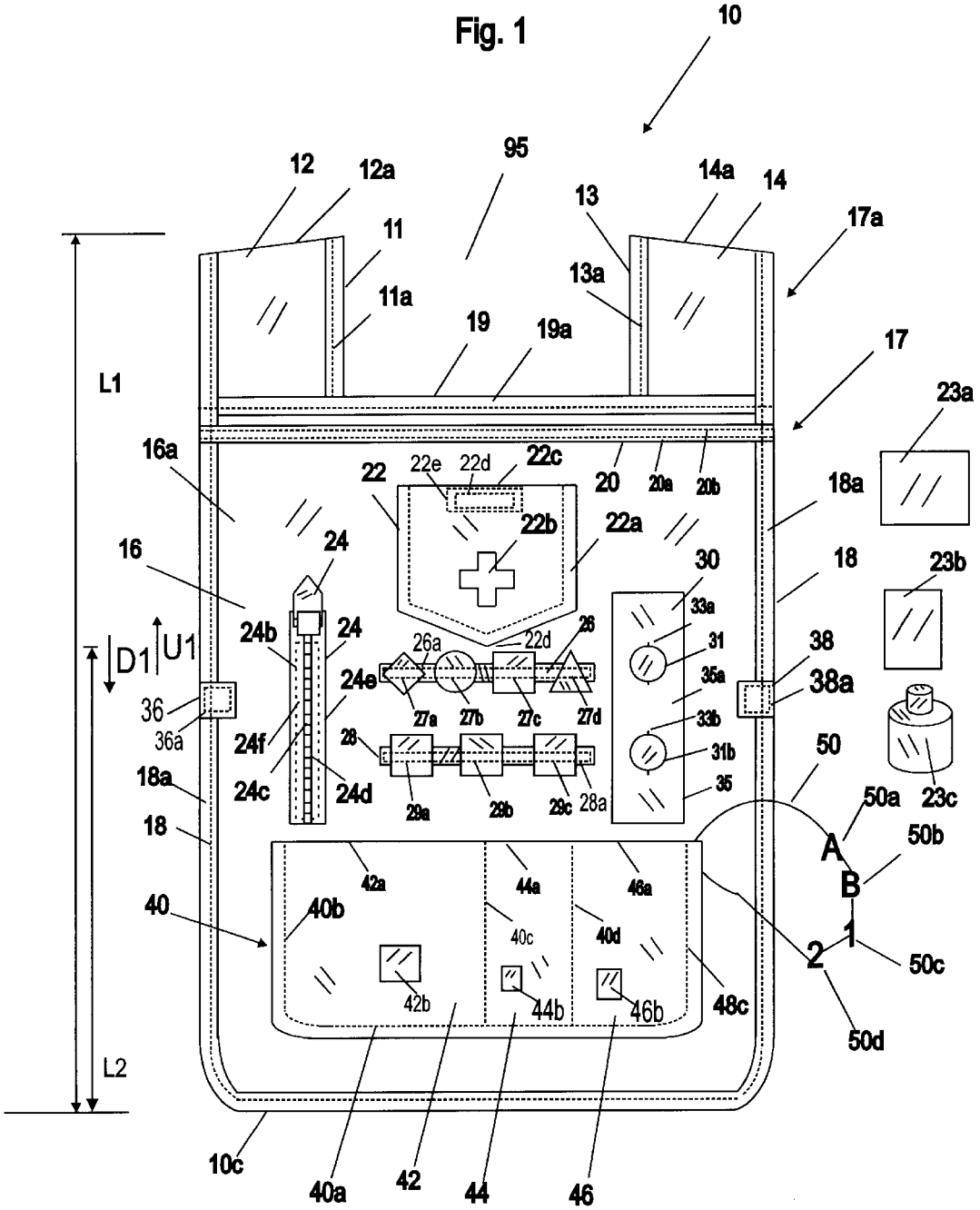
FIG. 1 shows a view an external side of a first portion of an apron for a child care giver in accordance with an embodiment of the present invention.

FIG. 1 shows a view of an external side 17*a* of a first portion 17 of an apron 10 for a child care giver in accordance with an embodiment of the present invention. The apron 10 includes portions 12, 14, and 16. The apron 10 also includes peripheral fringe 18 which is has a thread 18*a*, shown in dashed lines, sewn through it. Portions 12 and 14 includes flaps 11 and 13 which are sewn by threads 11*a* and 13*a*. The apron 10 may have a length of L1, which may be about 31 inches long. The apron 10 may have a color of canary yellow which is believed to be a stimulating color for children. The apron 10 should be made of light weight material and can be made of light weight denim material Tabard style apron.

Protein 16 includes an attachment device 20 which may be a strip of VELCRO (trademarked) which may be loops or hooks. The attachment device 20 may be sewn onto the portion 16 by threads 20*a* and 20*b*. Portion 16 includes a flap 19 which is sewn onto portion 16 by thread 19*a*. The apron 10 includes pockets 22, 42, 44, and 46. Pocket 22 has closed sides and a closed bottom which are formed by thread 22*a* and pocket 22 has an open top at opening 22*c*. An attachment device 22*d* which may be a Velcro (trademarked) rectangular shaped piece of material of hooks or loops which may be sewn on the top inside of pocket 22 and may be used for closing the pocket 22. The attachment device 22*d* may attach to attachment device 22*e* which may be a mating piece of VELCRO (trademarked) material having hooks or loops, and which may be sewn onto the portion 16 of the apron 10. The attachment devices 22*d* and 22*e* would keep first aid supplies from falling out or being taken out of pocket 22 by children. A red cross symbol 22*b* is shown fixed onto pocket 22. The red cross symbol 22*b* is a designation indicating that pocket 22 should be used for medical equipment such as Band-Aids and antiseptic wipes. The bottom 22*d* of pocket 22 may be located a distance L2, which may be greater than or equal to half the length L1 of the apron 10, which may be 15 and ½ inches, from the bottom 10*c* of the apron 10. The upper pocket 22 is positioned higher on the apron 10 so that a child cannot easily reach medical supplies within pocket 22.

Pockets 42, 44, and 46 are part of pocket group 40. The pockets are closed at their bottom by sewn threads 40*a*, and at their sides by sewn threads 40*b*, 40*c*, 40*d*, and 40*e*. Each pocket has an opening at the top. Pockets 42, 44, and 46 have openings 42*a*, 44*a*, and 46*a* at their top which allow insertion of items into the respective pockets and the holding of such inserted items.

Figure 2:
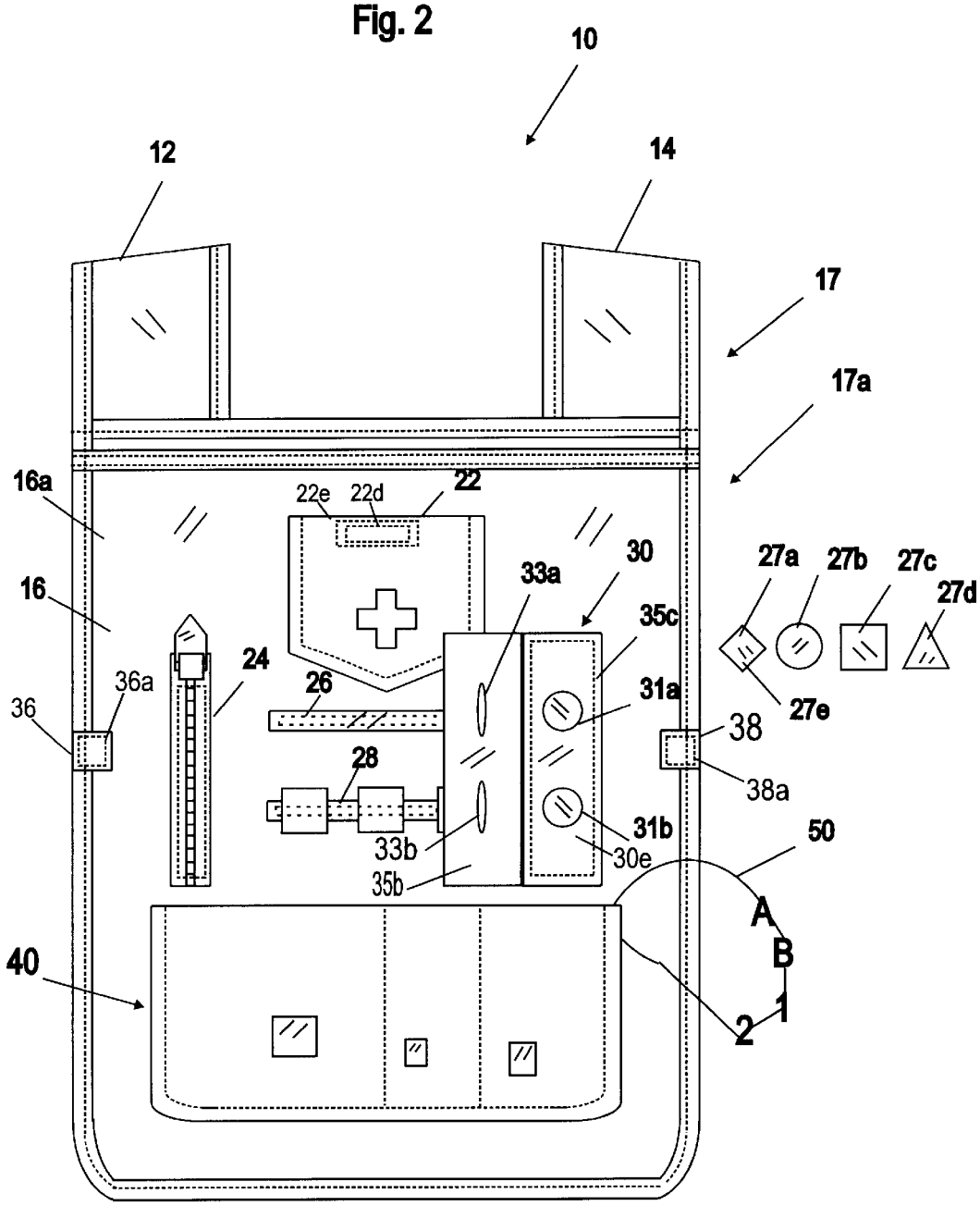
FIG. 2 shows a view of an external side of the first portion of the apron of FIG. 1 after a plurality of shaped objects have been removed from the first portion of the apron and after a cloth portion has been unbuttoned.

The portion 16 of the apron 10 includes attachment devices 26 and 28 both of which also may be strips of Velcro (TRADEMARKED) i.e. hooks or loops., sewn by threads 26*a* and 26*a* onto the portion 16 of the apron 10. Attachment device 26 may be used for attaching shaped items such as diamond shaped item 27*a*, circular shaped item 27*b*, square shaped item 27*c*, and triangular shaped item 27*d*. Each of these items may have matching VELCRO portions on the back of the item, which comes in contact with the attachment device 26. For example, square shaped item 27*c* may have hooks one side while attachment device 26 may have loops. In this manner, the square shaped item 27*c* (and the other items 27*a*, 27*b*, and 27*d*) can be attached to the attachment device 26. FIG. 2 shows a view of the external side 17*a* of the first portion 17 of the apron 10 of FIG. 1 after shaped items 27–*d* have been removed from the first portion 17 of the apron 10 and after a cloth portion 30 has been unbuttoned. The sides of the shaped items 27*a*–*d* shown in FIG. 2 may have Velcro (TRADEMARKED), i.e. hooks or loops, such as side 27*e* of shaped item 27*a*.

Attachment device 28 may be used for attaching touchable materials having a different feel. For example materials 29*a*–29*c* may be attached to the attachment device 28. Material 29*a* may be a feathery material, material 29*b* may be a plastic material, and material 29*c* may be a sandpaper material. Materials 29*a*–29*c* may be attached in a Velcro (TRADEMARKED), i.e. hooks and loops manner, as the shaped items 27*a*–*d* are attached to attachment device 26, or may be fixed to the attachment device 28.

The apron 10 also includes a zipper device 24. The zipper device 24 includes zipper 24*a*, material 24*b* connected to zipper teeth 24*c* and material 24*e* connected to zipper teeth 24*d*. The zipper teeth 24*c* and 24*d* are typically of a type known and teeth 24*c* and 24*d* hold tightly to one another when the zipper 24*a* is in the position of FIG. 1. The zipper 24*a* can be pulled down in a direction D1 to cause the zipper teeth 24*c* and 24*d* to separate and thus separate the material 24*b* and 24*e*. The zipper 24*a* can then be pulled back up again in the direction U1 to cause the zipper teeth 24*c* and 24*d* to join together again.

The portion 16 of the apron 10 includes a buttoning device 30. The buttoning device 30 includes buttons 31*a* and 31*b*. The button device 30 also includes slits 33*a* and 33*b* and material 35 which includes side 35*a* shown in FIG. 1. The material 35 of the button device 30 includes sides 35*a* (shown in FIG. 1) and sides 35*b* and 35*c* shown in FIG. 2.

Portion 16 of the apron 10 also includes attachment devices 36 and 38 which are sewn to portion 16 by stitches 36*a* and 38*a*, respectively.

The apron 10 also includes a cord 50 on which is held block objects 50*a*, 50*b*, 50*c*, and 50*d*, each of which is in the shape of a number or letter. Objects 50*a*–*d* are in the shape of "A", "B", "1", and "2", respectively. FIG. 1 also shows a box 23*a* for Band-Aids and a box 23*b* of antiseptic wipes, and a hand sanitizer 23*c* for placing in pocket 22.

Figure 3:
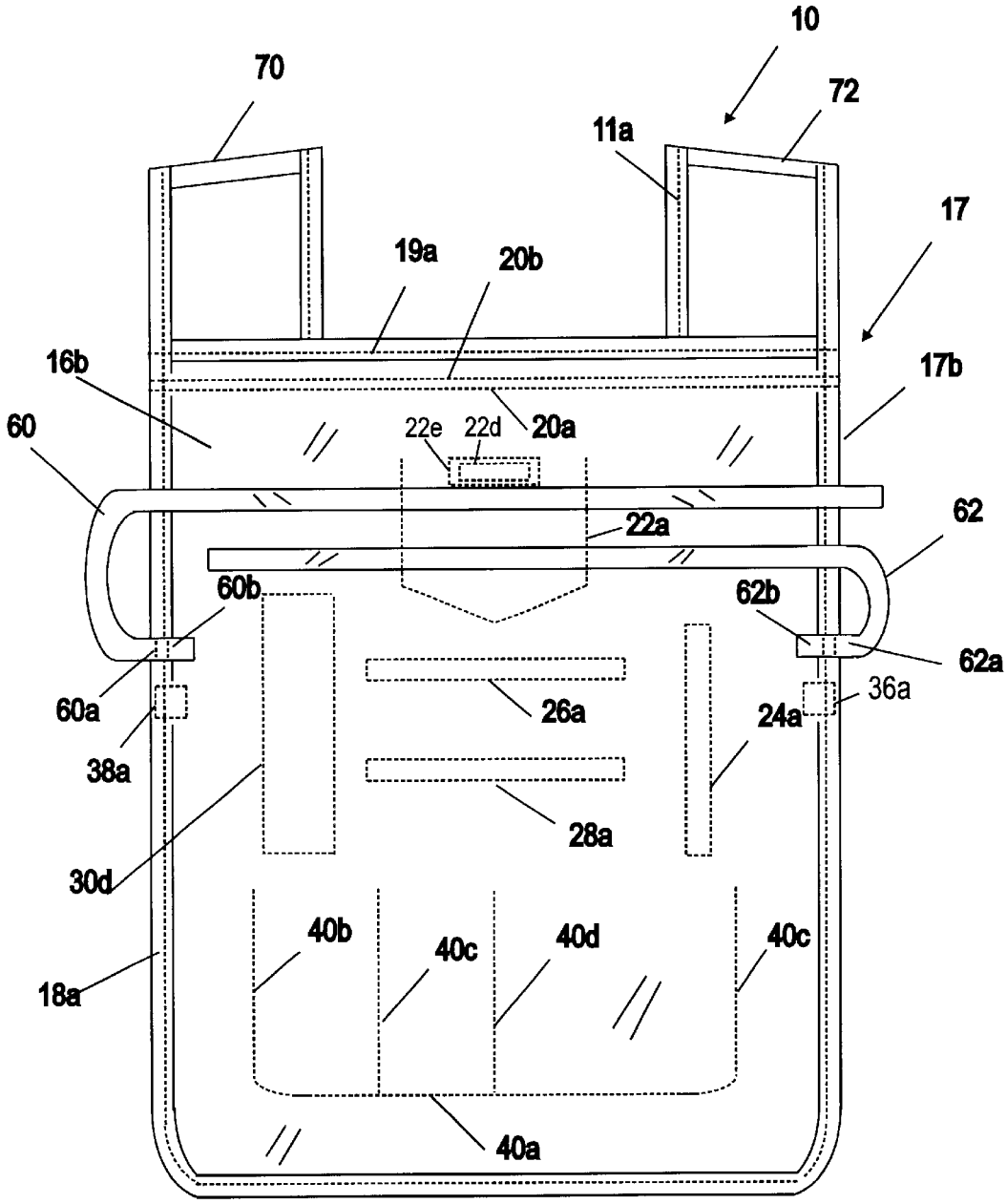
FIG. 3 shows a view of an internal side of the first portion of the apron of FIG. 1.

FIG. 3 shows a view of an internal side 17*b* of the first portion 17 of the apron 10 of FIG. 1. Stitches or threads 11*a*, 13*a*, 18*a*, 22*a*, 26*a*, 28*a*, 60*a*–60*b*, and 62*a*–*b*, 36, 38, 40*a*–40*e* are shown in FIG. 3. FIG. 3 also shows extensions 60 and 62 which can be used to tie the apron around a person's body. The extensions 60 and 62 are sewn onto portion 16 of apron 10 onto external side 17*b* of portion 17 by threads 60*a*–*b* and threads 62*a*–*b* as shown in FIG. 3.

Figure 4:
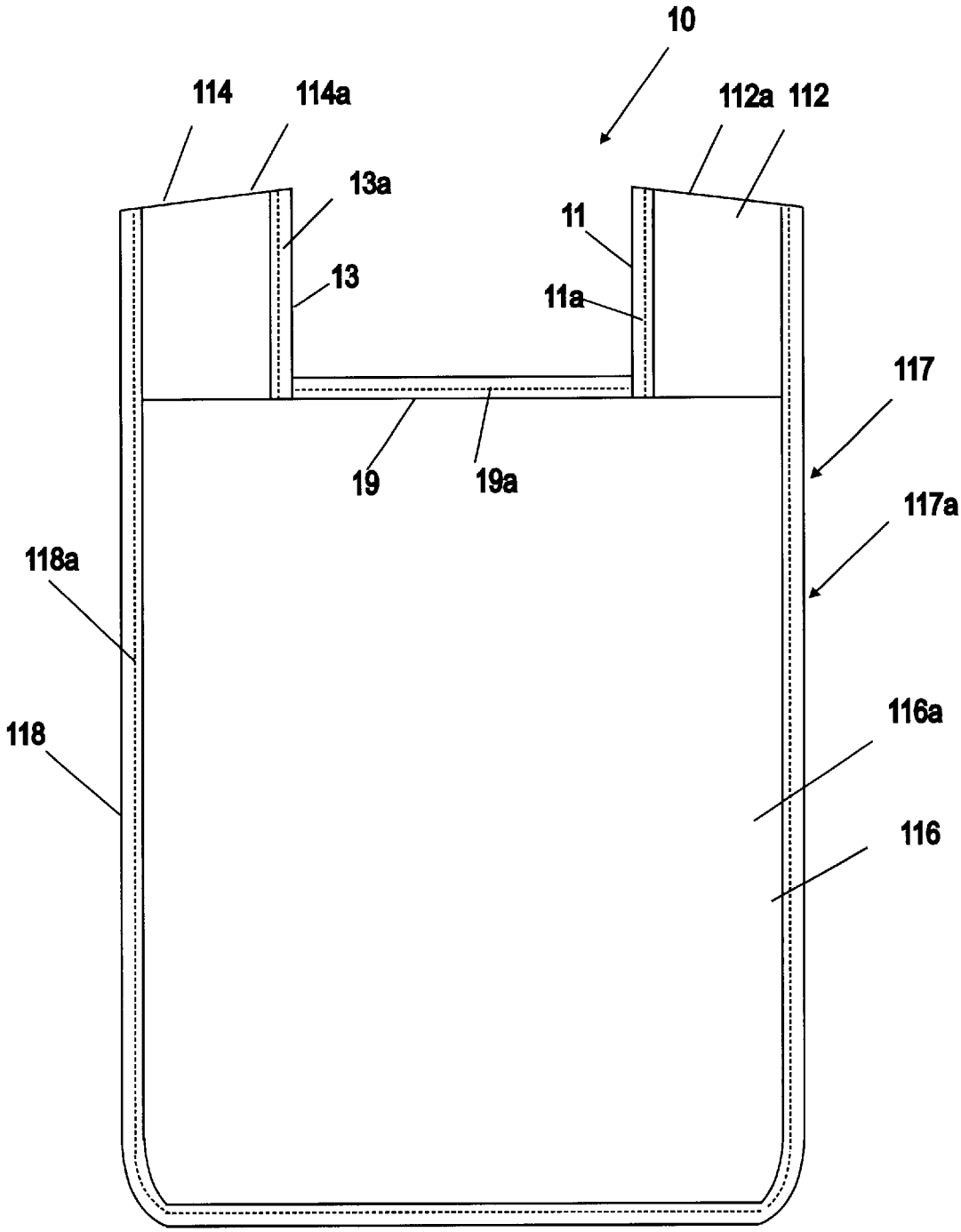
FIG. 4 shows a view of an external side of a second portion of the apron of FIG. 1.

FIG. 4 shows a view of an external side 117*a* of a second portion 117 of the apron 10 of FIG. 1. The second portion 117 may be connected to the first portion 17 shown in FIG. 1 so that top edges 12*a* and 14*a* shown in FIG. 1 are attached to top edges 112*a* and 114*a* shown in FIG. 4. The external side 117*a* would face outwards from the back of a person and the external side 17*a* would face outwards from the front torso of a person wearing the apron 10. The person's neck would lie between portions 112 and 114 and between portions 12 and 14.

Figure 5:
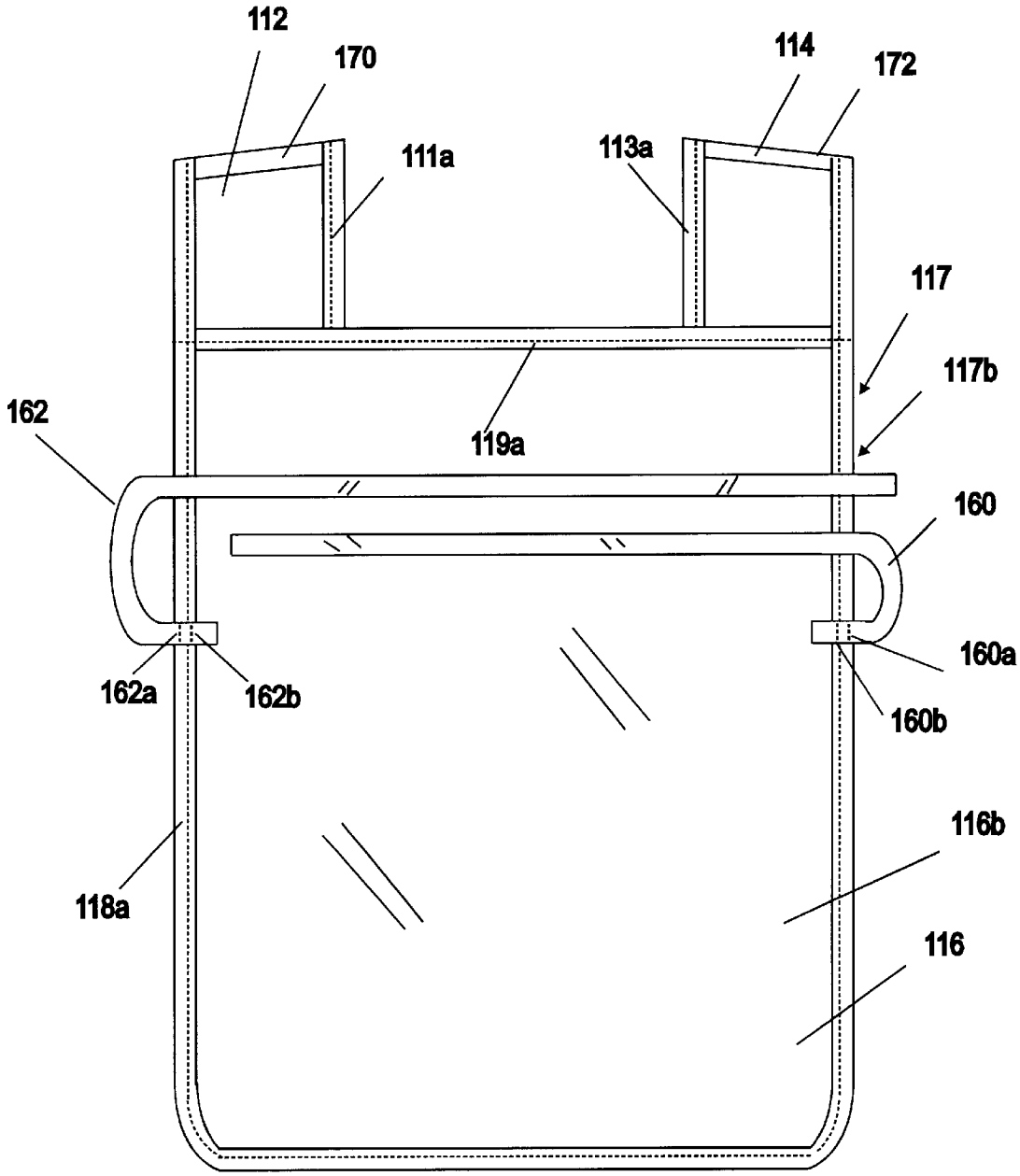
FIG. 5 shows a view of an internal side of a second portion of the apron of FIG. 1.

FIG. 5 shows a view of an internal side 117*b* of the second portion 117 of the apron 10 of FIG. 1. The internal side 117*b* would contact the back of the person who is wearing apron 10. FIG. 5 shows threads or stitches 111*a*, 113*a*, and 118*a*. FIG. 5 also shows flaps 170 and 172 and extensions 160 and 162 for tying the apron 10 to an individual. Extensions 160 and 162 are stitched on by stitches 160*a*–*b* and 162*a*–*b* shown in FIG. 5. Extension 160 by be tied to extension 60 and extension 162 may be tied to extension 62 in order to secure the apron 10 to the body of a child care giver.

Figure 6:
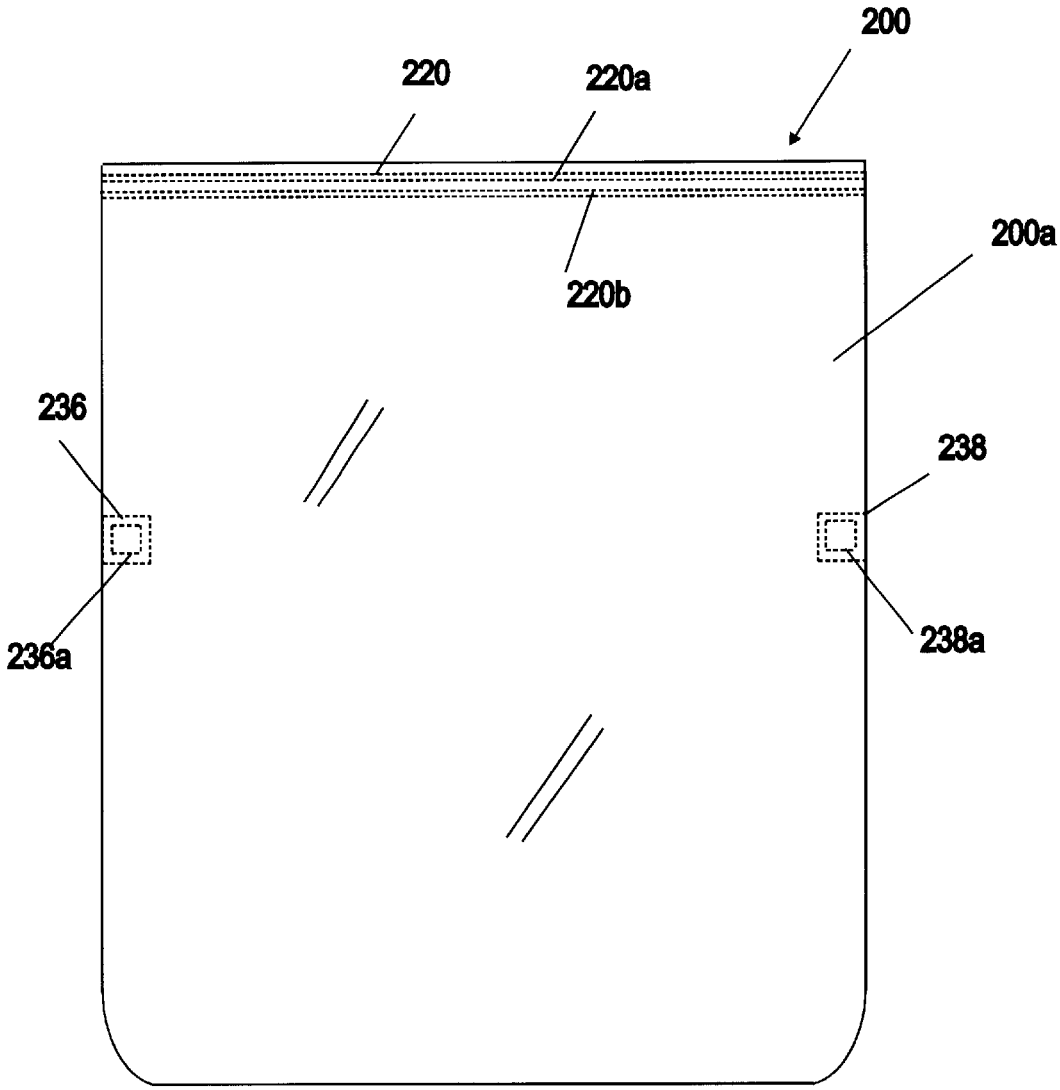
FIG. 6 shows a front view of a protective device for placing over the external side of the first portion of the apron of FIG. 1.
Figure 7:
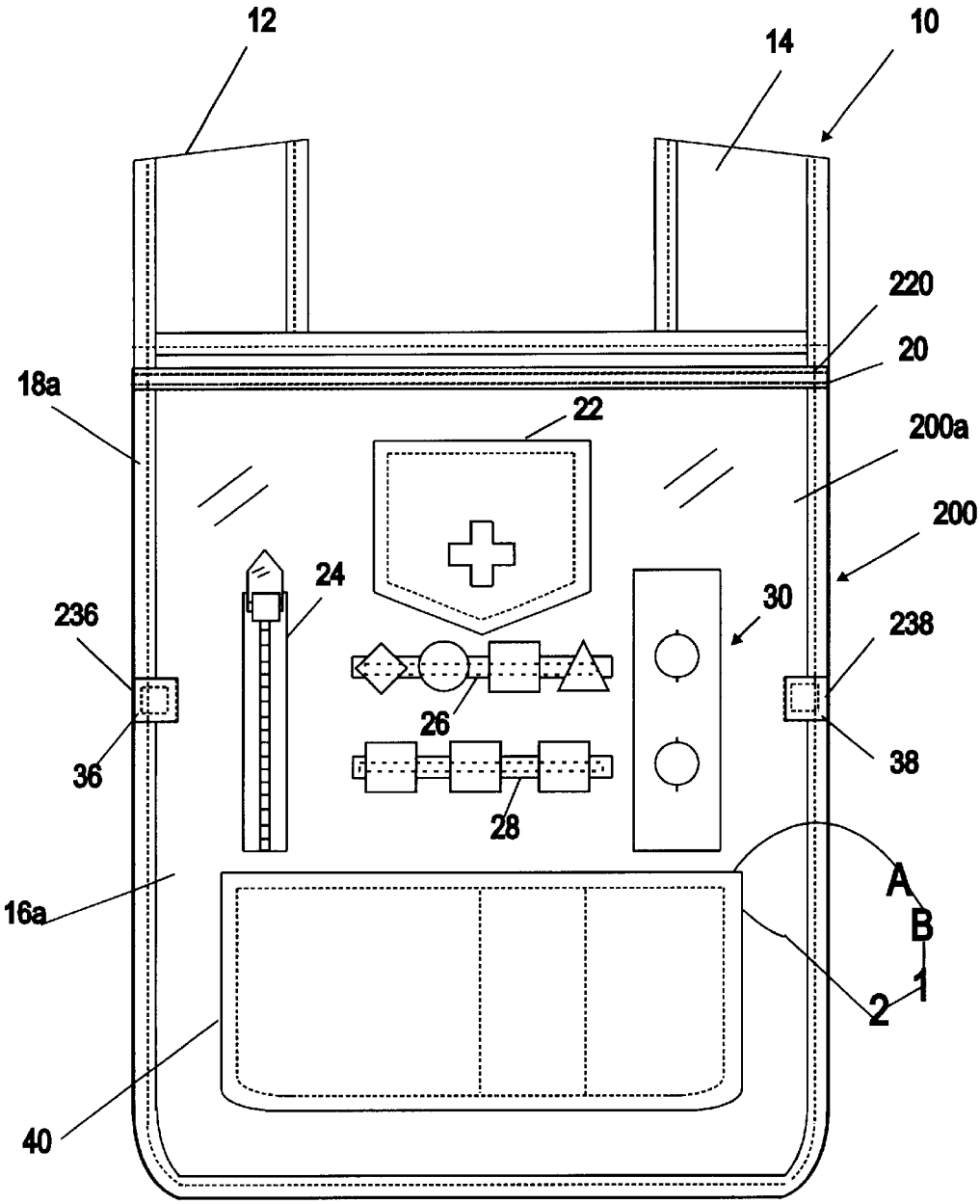
FIG. 7 shows the protective device of FIG. 6 placed over the external side of the first portion of the apron shown in FIG. 1.

FIG. 6 shows a front view of a protective device 200 for placing over the external side 17*a* of the first portion 17 of the apron 10 of FIG. 1. The protective device 200 may be comprised of a clear plastic portion 200*a*. Attached to the clear plastic portion 200*a* by stitches or threads 220*a*, 236*a*, and 238*a* may be attachment devices 220, 236, and 238. FIG. 7 shows the protective device 200 of FIG. 6 placed over the external side 17*a* of the first portion 17 of the apron 10 shown in FIG. 1. In FIG. 7, nearly the entire side 16*a* of portion 16 is covered by the protective device 200. In particular the pocket 22, pocket group 40, zipper device 24, attachment devices 26 and 28 and items for attachment, and buttoning device 30 are all covered by the protective device 200. The attachment devices 220, 236, and 238 may be matching Velcro pieces, such as hooks or loops which match with attachment devices 20, 36, and 38 respectively, to attach the protective device to the side 16*a* of the portion 16 of the apron 10. The combination of the protective device 200 and the apron 10 can also be termed an apron or a modified apron.

Figure 8:
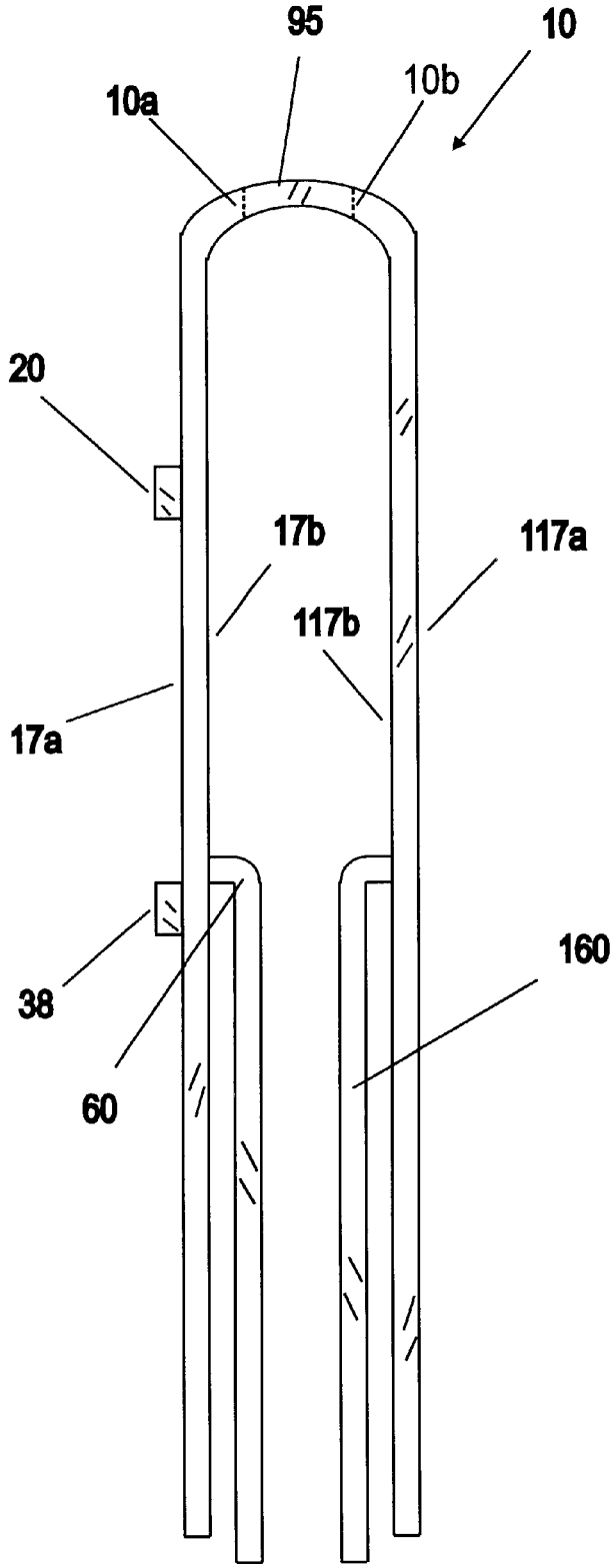
FIG. 8 shows a right side view of the apron of FIG. 1.

FIG. 8 shows a right side view of the apron 10 of FIG. 1. FIG. 8 shows attachment devices 20 and 38, and extensions 60 and 160. FIG. 8 also shows sides 17*a*, 17*b*, 117*b*, and 117*a* of the apron 10. Dashed lines 10*a* and 10*b* show the location of neck opening 95.

In operation, referring to FIGS. 1–8, a child care giver may put the apron 10 on by placing the apron 10 over the child care giver's head, such that portions 12, 14, 112, and 114 lie on the shoulders of the child care give and the child care giver's neck is in opening 95. The apron 10 can be secured around the torso of the care giver by tying extensions 60 and 160 together and by tying extensions 62 and 162 together, referring to FIGS. 3, 5, and 8.

After the apron 10 has been secured, the child care giver may allow a child to pull the zipper device down in direction D1 or up in the direction U1, shown in FIG. 1. The child can also pull the shaped items 27*a*–*d* of the attachment device 26. The child may feel the touchable items 29*a*–*c* or button or unbutton the buttoning device 30. The child care giver may provide medical attention to a child that needs it with items taken from pocket 22. The child can see and touch the letter and number items 50*a*–50*d* on the cord 50. The care giver can place and secure the protective device 200 onto the apron 10 to protect the apron 10 and the care giver at an appropriate time. For example, if the children are working with paints, eating, drinking, or doing some other activity where the apron 10 is likely to be stained, or germs are likely to result on the apron 10, the protective device 200 can be placed on apron 10 and secured. The care giver would place the protective device 200 over the apron 10 so that attachment devices 236 and 36 attach together and attachment device 236 and 38 attach together.

The attachment devices 36, 236, 38, and 238 may be comprised of ½ inch square pieces of Velcro (trademarked) portions, such as hooks or loops. (I.e. if attachment device 236 is hooks, then attachment device 36 should be loops). Other attachment devices such as tape, buttons, pins, zippers or other known attachment devices can be provided for 36, 236, 38, and 238. However, Velcro (trademarked) or a similar material that will generally not puncture the protective device 200 is preferred. Puncture holes in the protective device 200 would cause device 200 to loose its effectiveness by allowing for example paints or bodily fluids to leak through the protective device 200 onto the individual wearing the device 200 or onto the apron 10.

The apron 10 may also include various child friendly iron on decals on the side 17*a*. For example apron 10 may include iron on decals 42*b*, 44*b*,or 46*b*, which may be cartoon characters such as Bugs Bunny (TRADEMARKED).

The various devices of the apron 10, which can be manipulated by children, such as zipper device 24, shaped items 27*a–d*, touchable items 29*a–c*, buttoning device 30, and items 50*a–d* encourage children in developing language skills. The canary yellow color of apron 10 also aids in this purpose. Concepts of colors, counting, shapes, and recognition of numbers and alphabets can be taught by child care givers by using the apron 10. Development of fine motor skills of zipping, buttoning, along with sensory perception can be enjoyed by individual children who interact with the wearer of the apron 10.

Although the invention has been described by reference to particular illustrative embodiments thereof, many changes and modifications of the invention may become apparent to those skilled in the art without departing from the spirit and scope of the invention. It is therefore intended to include within the patent all such changes and modifications as may reasonably and properly be included within the scope of the present invention's contribution to the art.

I claim:

1. An apparatus comprising:

an apron comprising:
a first attachment device; and further comprising a plurality of shaped items including a first shaped item and a second shaped item;

wherein each of the plurality of shaped items can be attached to the first attachment device and thereby attached to the apron;

wherein each of the plurality of shaped items is completely and individually detachable from the first attachment device and from the apron;

wherein the first shaped item has a square shape;

wherein the second shaped item has triangular shape; and wherein the first shaped item can be placed adjacent to the second shaped item on the apron and on the first attachment device.

2. The apparatus of claim 1 wherein the apron is further comprised of a second attachment device;

and further comprising a plurality of touchable items each touchable item having a type of material, each type of material feeling different when touched; and wherein each of the plurality of touchable items is substantially the same size and shape as each of the other of the plurality of touchable items;

wherein each of the plurality of touchable items can be completely and individually attached and detached from the second attachment device;

and wherein a first touchable item of the plurality of touchable items can be attached adjacent to a second touchable item of the plurality of touchable items.

3. The apparatus of claim 2 wherein the first touchable item of the plurality of touchable items is soft and the second touchable item of the plurality of touchable items is rough.

4. The apparatus of claim 2 wherein the first touchable item of the plurality of touchable items is a feather and the second touchable item of the plurality of touchable items is sandpaper.

5. The apparatus of claim 1 further comprising a zipper device.

6. The apparatus of claim 1 further comprising a buttoning device.

7. The apparatus of claim 1 further comprising an upper pocket having a designation indicating that the upper pocket is be used for storing medical supplies.

8. The apparatus of claim 1 further comprising a lower group of pockets.

9. an apparatus comprising:

an apron comprising:
a first attachment device;

further comprising a plurality of shaped items;

wherein each of the plurality of shaped items can be attached to the first attachment device and thereby attached to the apron;

and wherein the apron is comprised of a second attachment device;

and further comprising a protective device having a third attachment device; and wherein the protective device can be attached to the apron by attaching the second attachment device to the third attachment device, so that the protective device completely covers the first attachment device and any of the plurality of shaped items which are attached to the first attachment device;

and wherein the protective device can be completely detached from the apron.

10. The apparatus of claim 9 wherein the protective device is made of a clear plastic so that an individual can see through the protective device and thus see any of the plurality of shaped items which are attached to the apron.

11. A method comprising the steps of:

attaching a first attachment device to an apron for a child care giver;

attaching a plurality of shaped items to the first attachment device; and individually and completely detaching each of the plurality of shaped items from the first attachment device;

wherein the first shaped item has a square shape;

wherein the second shaped item has a triangular shape; and wherein the first shaped item can be placed adjacent to the second shaped item on the apron and on the first attachment device.

12. The method of claim 11 further comprising the steps of:

attaching a second attachment device to the apron; and attaching a plurality of touchable items to the second attachment device, each of the plurality of touchable items having a type of material, each type of material feeling different when touched; and individually and completely detaching each of the plurality of touchable items from the second attachment device and from the apron;

wherein each of the plurality of touchable items is substantially the same size and shape as each of the other of the plurality of touchable items;

and wherein a first touchable item of the plurality of touchable items can be attached adjacent to a second touchable item of the plurality of touchable items on the second attachment device and on the apron.

13. The method of claim 12 further wherein the first touchable item of the plurality of touchable items is soft and the second touchable item of the plurality of touchable items is rough.

14. The method of claim 13 wherein the first touchable item of the plurality of touchable items is made of feathery material and the second touchable item of the plurality of touchable items is made of sandpaper material.

15. The method of claim 11 further comprising attaching a zipper device to the apron.

16. The method of claim 11 further comprising attaching a buttoning device to the apron.

17. The method of claim 11 further comprising attaching an upper pocket to the apron having a designation indicating that the upper pocket is be used for storing medical supplies.

18. The method of claim 11 further comprising attaching a lower group of pockets to the apron.

19. The method of claim 11 further comprising attaching a protective device to the apron such that it covers the first attachment device and the plurality of shaped items.

20. The method of claim 12 further comprising attaching a protective device to the apron such that it covers the second attachment device and the plurality of touchable items.

21. The method of claim 19 wherein the protective device is attached so that it can be easily and completely detached from the apron.

22. The method of claim 20 wherein the protective device is attached so that it can be easily and completely detached from the apron.

23. A method comprising attaching a first attachment device to an apron for a child care giver;

attaching a plurality of touchable items to the first attachment device each of the plurality of touchable items having a type of material, each type of material feeling different when touched; and individually and completely detaching each of the plurality of touchable items from the first attachment device and from the apron;

wherein each of the plurality of touchable items is substantially the same size and shape as each of the other of the plurality of touchable items;

and wherein a first touchable item of the plurality of touchable items can be attached adjacent to a second touchable item of the plurality of touchable items on the first attachment device and on the apron .

24. An apparatus comprising an apron comprising:

a first attachment device;

and further comprising a plurality of touchable items-each touchable item having a type of material, each type of material feeling different when touched; and wherein each of the plurality of touchable items is substantially the same size and shape as each of the other of the plurality of touchable items;

wherein each of the plurality of touchable items can be completely and individually attached and detached from the second attachment device;

and wherein a first touchable item of the plurality of touchable items can be attached adjacent to a second touchable item of the plurality of touchable items to the first attachment device.

* * * * *